US008490429B2

(12) United States Patent
Huynh

(10) Patent No.: US 8,490,429 B2
(45) Date of Patent: Jul. 23, 2013

(54) ARTICLE OF JEWELRY HAVING REPULSIVE MAGNETIC ELEMENTS AND METHODS OF MANUFACTURING

(71) Applicant: Chi Huynh, San Dimas, CA (US)

(72) Inventor: Chi Huynh, San Dimas, CA (US)

( * ) Notice: Subject to any disclaimer, the term of this patent is extended or adjusted under 35 U.S.C. 154(b) by 0 days.

(21) Appl. No.: 13/743,102

(22) Filed: Jan. 16, 2013

(65) Prior Publication Data

US 2013/0125584 A1 May 23, 2013

Related U.S. Application Data

(62) Division of application No. 12/940,949, filed on Nov. 5, 2010, now Pat. No. 8,375,586.

(51) Int. Cl.
*A44C 17/02* (2006.01)
*A44C 27/00* (2006.01)

(52) U.S. Cl.
USPC ..... 63/29.2; 63/3; 63/3.1; 63/32; 63/38; 29/896.41; 29/10

(58) Field of Classification Search
USPC ..... 63/3.31, 29.2, 29.1, 32, 38; 29/10, 29/896.4, 896.41, 896.411, 896.412, 896.42, 29/896.43, 446, 469, 505, 512
See application file for complete search history.

(56) References Cited

U.S. PATENT DOCUMENTS

| | | | |
|---|---|---|---|
| 715,795 | A | 12/1902 | Haskel |
| D203,551 | S | 1/1966 | Tranfield |
| 4,052,864 | A | 10/1977 | Hofsaess |
| 4,905,335 | A | 3/1990 | Tervola |
| 4,912,944 | A | 4/1990 | Crosley et al. |
| 5,197,168 | A | 3/1993 | Levy |
| D342,916 | S | 1/1994 | Giralt |
| D392,585 | S | 3/1998 | Kohl |
| 5,921,110 | A | 7/1999 | Middendorff et al. |
| 5,989,178 | A | 11/1999 | Chiu |
| 6,101,843 | A | 8/2000 | Nagano |
| D440,180 | S | 4/2001 | Giesen |
| D442,509 | S | 5/2001 | Yamanaka |
| D444,094 | S | 6/2001 | Boehm |
| 6,497,117 | B2 | 12/2002 | Ofiesh, II |
| 6,532,765 | B1 | 3/2003 | Hurwitz |
| 6,594,871 | B2 | 7/2003 | Hoffman |
| D480,981 | S | 10/2003 | Pasquetti |
| 6,715,315 | B1 | 4/2004 | Hartgrove |
| D495,616 | S | 9/2004 | Fountoulakis |
| 6,851,279 | B2 | 2/2005 | Hartgrove |
| 6,962,063 | B1 | 11/2005 | Pearl |
| 7,013,674 | B2 | 3/2006 | Kretchmer |

(Continued)

FOREIGN PATENT DOCUMENTS

DE 29913811 U1 10/1999

OTHER PUBLICATIONS

Machine Translation of DE 29913811 U1.

*Primary Examiner* — Sarang Afzali
(74) *Attorney, Agent, or Firm* — Biotech Beach Law Group PC

(57) ABSTRACT

An article of jewelry including a pliable strand; and a plurality of precious or semiprecious objects movably positioned along the pliable strand. Each of the plurality of objects including a magnetic insert extending between opposing surfaces, which itself is formed from two magnets separated by a magnetic stabilizer and aligned such that the opposing ends of the magnetic insert have the same polarity thereby creating repulsive forces between each of the plurality of objects along the strand.

13 Claims, 10 Drawing Sheets

U.S. PATENT DOCUMENTS

| | | | |
|---|---|---|---|
| 7,143,607 | B2 | 12/2006 | Hartgrove |
| 7,201,021 | B2 | 4/2007 | Hartgrove |
| 7,216,508 | B2 | 5/2007 | Kretchmer et al. |
| D601,054 | S | 9/2009 | Siviere |
| D626,025 | S | 10/2010 | Iacomucci |
| 8,113,013 | B2 | 2/2012 | Kessler |
| D668,985 | S | 10/2012 | Huynh |
| 2005/0039488 | A1 | 2/2005 | Dunmire |
| 2006/0174649 | A1 | 8/2006 | Azrielant |
| 2007/0084241 | A1 | 4/2007 | Kretchmer et al. |
| 2007/0095101 | A1 | 5/2007 | Pons |

ARTICLE OF JEWELRY HAVING REPULSIVE MAGNETIC ELEMENTS AND METHODS OF MANUFACTURING

CROSS REFERENCE TO RELATED APPLICATIONS

This is a divisional of U.S. patent application Ser. No. 12/940,949 filed Nov. 5, 2010, the contents of which are herein incorporated by reference in their entirety.

TECHNICAL FIELD

The invention relates to articles of jewelry having magnetic elements and more specifically a plurality of precious or semiprecious objects, each having a magnetic insert with a same polarity at each end, which repels objects from one another along a pliable strand.

BACKGROUND OF THE INVENTION

Articles of jewelry are generally constructed by linking together multiple precious or semiprecious gems. However, in many instances closely joining such objects risks contact and thus rubbing or marring of the gem. Accordingly different approaches have been developed including gluing or clasping gems in a particular location; however, this can prevent rotation of the gem, which in some instances is desired.

Another approach is to provide a plurality of knots between each of a plurality of gems. For instance, a typical strand of pearls includes knots which prevent neighboring pearls from rubbing against one another and adversely affecting the appearance of the gems. However, this approach is time consuming and limits the position of each object along the strand. In addition, the diameter of throughbores and knot diameters must also be considered and tightly controlled, which requires a high degree of precision. Still another consideration is that the approach does not prevent rubbing during storage. As such, storage requires specialized holders to prevent rubbing between gems, which adds to costs and can be inconvenient.

The use of magnets to join jewelry components is well known. For instance, U.S. Pat. No. 6,594,871 issued to Hoffman provides jewelry with replaceable ornamentation. Hoffman permits the substitution of multiple decorative elements to a base using a pair of magnets; the first being press fit into a recess of the base and the second adhesively attached to the decorative element. Thus, magnetic attraction holds the chosen decorative element to the base.

Another approach is considered in US 2007/0084241 to Kretchmer et al., which provides magnetic repulsion components for jewelry articles. Specifically, traditional magnets are arranged to direct repulsive forces between neighboring components. That is, the configuration of each neighboring magnet is reversed such that north poles face one another and south poles face one another between neighboring components. However, this configuration requires the components be positioned along a rigid rod. Without the rigid rod, neighboring magnetic elements would tend to flip over to orient north and south poles together. Further, while nearest neighbor components are oriented such that poles having the same polarity face one another, this configuration inherently requires each next nearest neighbor to be oriented in the same direction, which if the rod where pliable would result in attraction between every other neighbor. Still further, the rigid rod prevents the article from bunching or knotting when being stored since north and south poles would naturally attract components throughout the article leading to scratching and marring of the components.

Thus, it would be desirable to provide an article of jewelry that eliminates the need for clasping decorative elements to a strand and knotting strands between decorative elements. It would also be desirable to provide an article that uses repulsive forces to prevent contact between objects yet is practical when using a pliable strand in lieu of a rigid rod.

BRIEF SUMMARY OF THE INVENTION

It is an object of the invention to provide an article of jewelry that prevents contact between gemstones or objects without the need for physical barriers between them. It is another object of the invention to provide such an article that can be used with a pliable strand.

The above is accomplished by providing an article of jewelry, which includes, a pliable strand; and a plurality of precious or semiprecious objects movably positioned along the pliable strand. Each of the plurality of objects includes a magnetic insert extending between opposing surfaces, which itself is formed from two magnets separated by a magnetic stabilizer and aligned such that the opposing ends of the magnetic insert have the same polarity thereby creating repulsive forces between each of the plurality of objects. Thus, each object includes the same outer magnetic orientation or polarity which causes repulsion between each object. As such, contact between each object is prevented without need of a physical barrier between objects and without requiring a rigid support rod.

In a preferred embodiment the article of jewelry is formed by providing a plurality of precious or semiprecious objects; forming a throughbore in each object; forming a magnetic insert including two magnets separated by a magnetic stabilizer, wherein opposing ends of the magnetic insert have the same pole; forming a second throughbore along the length of the magnetic insert; securing the magnetic insert within the throughbore of each object; and threading a pliable strand through the second throughbore of each object.

DETAILED DESCRIPTION OF THE INVENTION

Figure 1:
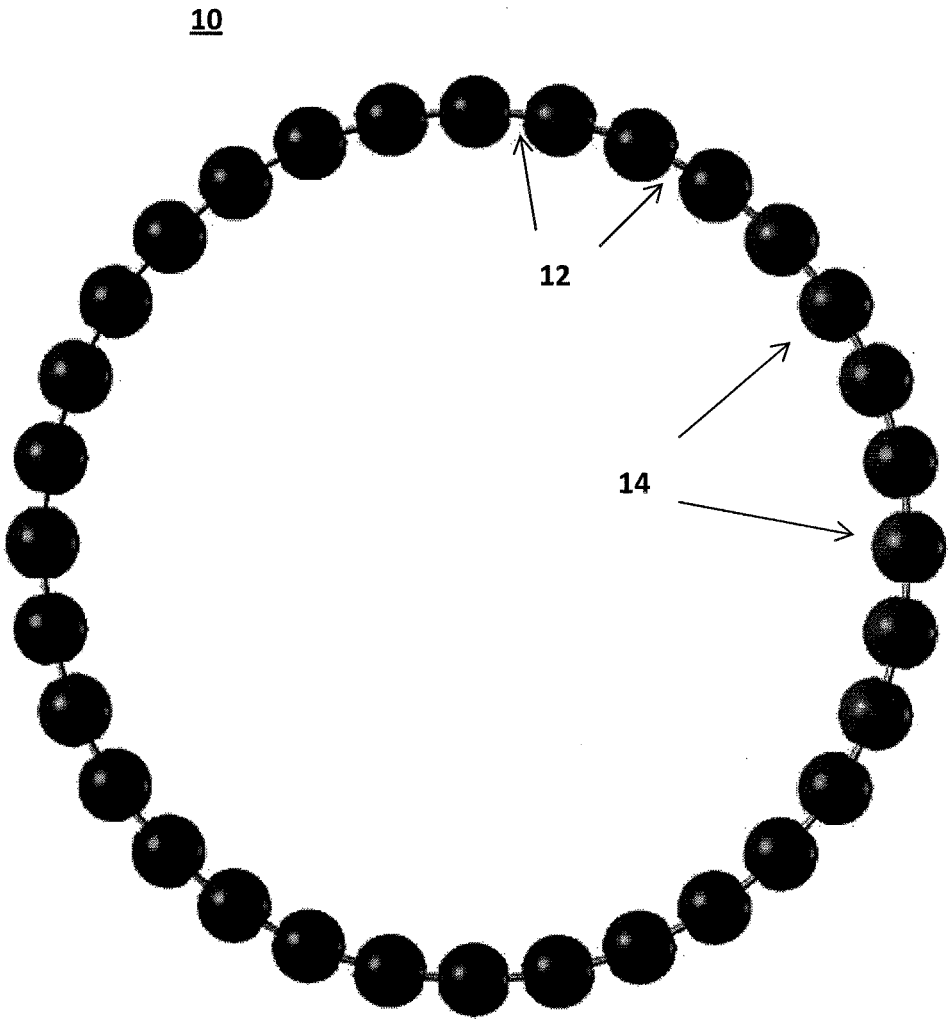
FIG. 1 depicts a necklace 10 having a pliable strand 12 and a plurality of objects 14 separated from one another by magnetic repulsive forces.

Jewelry articles according to invention may be better understood with reference to the drawings and the accompanying description. Referring now to the drawings, FIG. 1 depicts a jewelry article constructed in the form of a necklace, generally designated 10. However, the jewelry article can be adapted for a variety of jewelry pieces, such as a bracelet, an earring, a pendent, a charm, a tie tack, a cuff link and the like.

The preferred article of jewelry includes a pliable strand 12, and a plurality of precious or semiprecious objects 14 movably positioned along the pliable strand 12. By "pliable" it is meant that the strand 12 is not rigid. A pliable strand 12 will generally bend or deform by the weight of a few grams if not held taught. In some instances the strand 12 is formed from rope, twine or the like. In other embodiments, the strand 12 is formed from chain. Each of which are conventionally known in the jewelry arts. The object 14 is intended to encompass precious or semiprecious gems, glass beads, plastic beads, porcelain materials and the like. Gems can be any such gemstones used in the jewelry arts such as an agate, an alexandrite, an amber, an ametrine, an amethyst, an aquamarine, an apatile, a beryl, a bloodstone, a chrysoberyl or cat-eye, a citrine, a corundum, a chalcedony, a chysocolla, a coral, a diamond, an emerald, a green beryl, a garnet, a quartz, a lolite, a jadcite, a kupzite, a lapis lazuli, a moonstone, a malachite, a moamite, an onyx, an opal, a peridot, a red corundum, a ruby, a sardonyx, a sapphire, a spessartime, a sphene, a spinel, a star ruby and sapphiren, a sunstone, a tanzanite, a tiger eye, a tourmaline, a topaz, a turquoise, a tsavorite, and a zircon. The object is typically sized from about 1 mm to about 25 mm, and more often from about 5 mm to about 12 mm.

As can be seen in FIG. 1, preferably each of the plurality of objects 14 avoids contact with one another. The terms "avoids contact" and "contact is prevented" refers to the ability of objects 14 to be free from contact from one another while the article of jewelry is worn, such as overcoming forces of gravity which would exert downward forces to pull objects 14 towards the low point of the article of jewelry. The terms also can be used to refer to the ability of the objects 14 to avoid contact when placed on a level surface. Contact is avoided between objects 14 without the inclusion of barriers along the strand 12. Naturally a clasp for opening or closing a looped strand 12 would not be considered within the meaning of a barrier. For instance, preferably the strand 12 lacks knots or similar physical barriers between objects 14, which is in contrast to traditional design of pearl strands. Preferably, the objects 14 freely rotate around the strand 12 and are thus not pinched or clasped directly to the strand 12.

Figure 2:
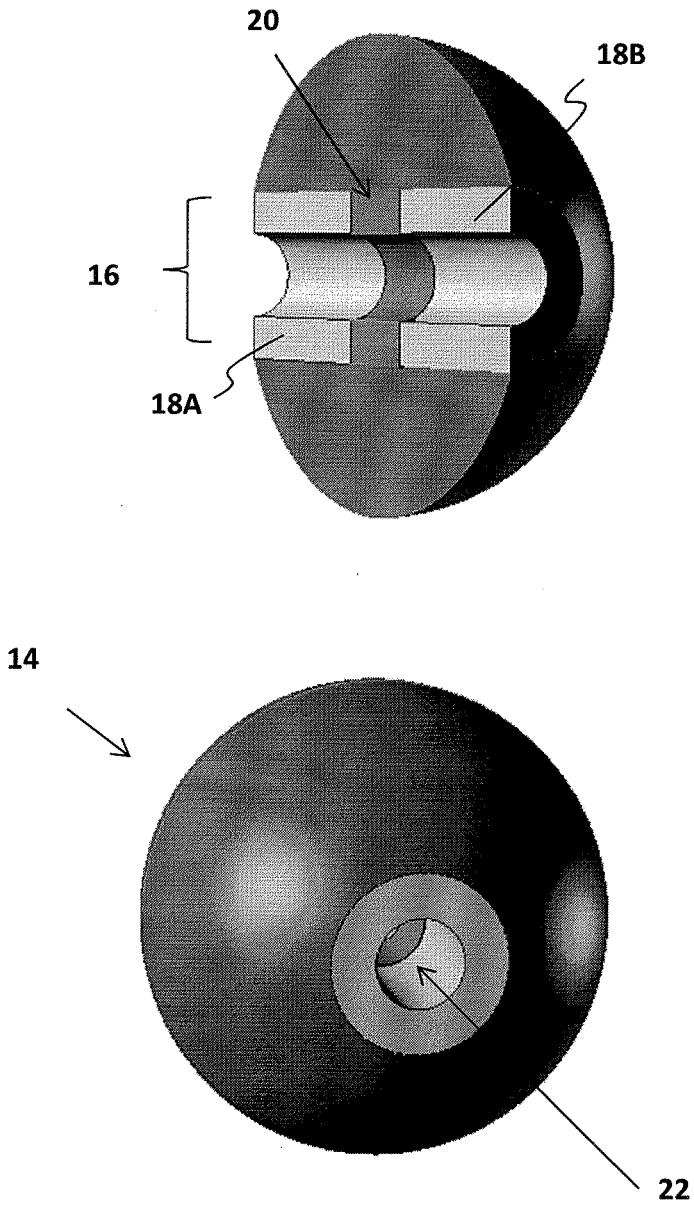
FIG. 2 depicts an exemplary object 14 cross sectioned to depict the magnetic insert 16 formed from two magnets 18A, 18B and a magnetic stabilizer 20. A magnetic insert throughbore 22 is also shown.
Figure 3:
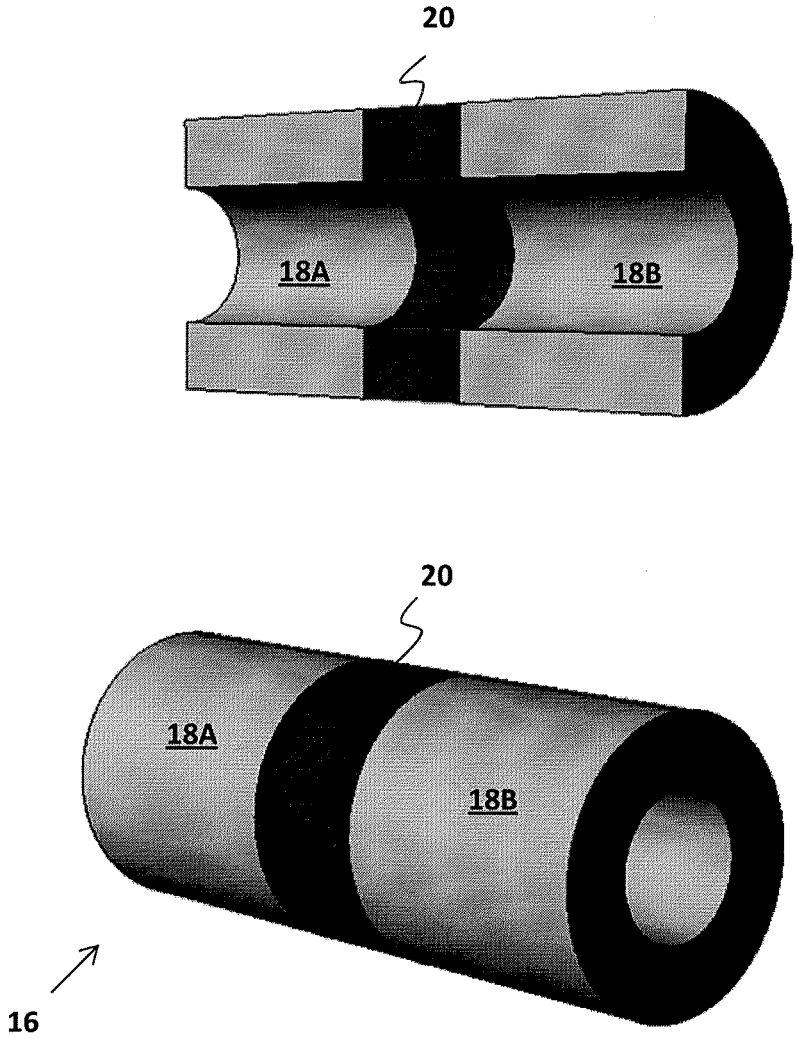
FIG. 3 depicts an exemplary magnetic insert 16 cross section to depict the two magnets 18A, 18B and a magnetic stabilizer 20.
Figure 4:
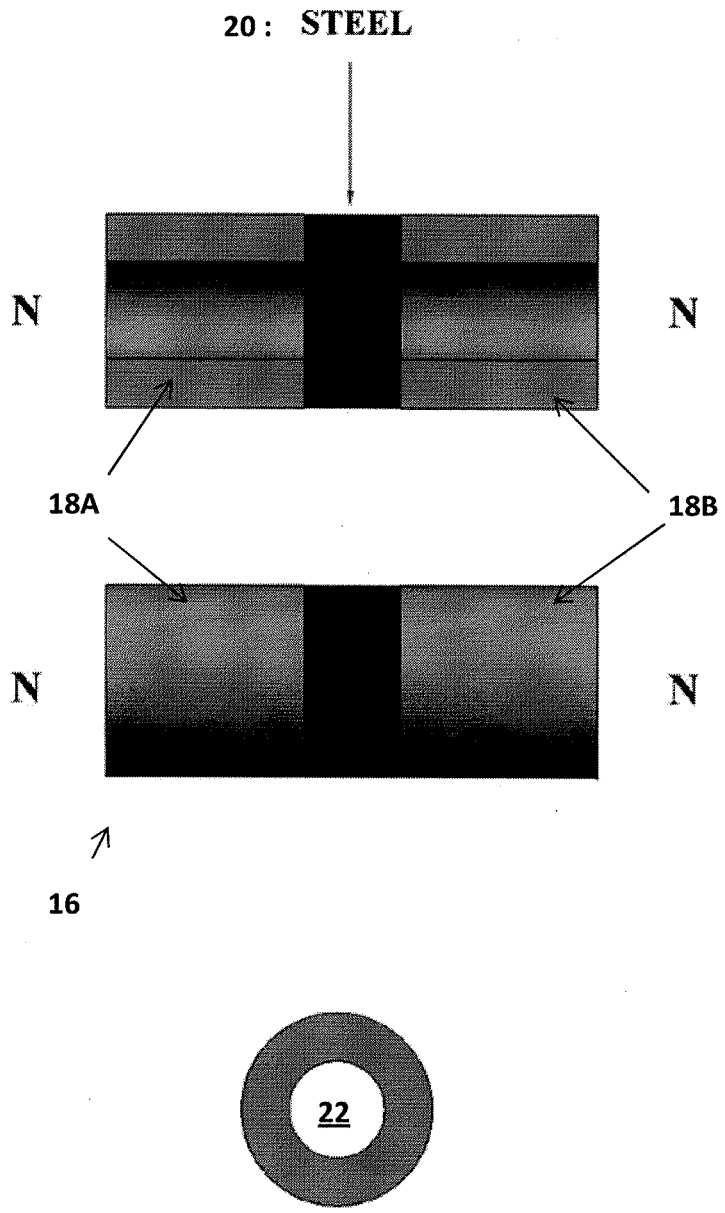
FIG. 4 depicts a preferred orientation of magnetic poles at opposing surfaces of the magnetic insert 16 and demonstrates a preferred magnetic stabilizer 20 formed from steel.
Figure 5:
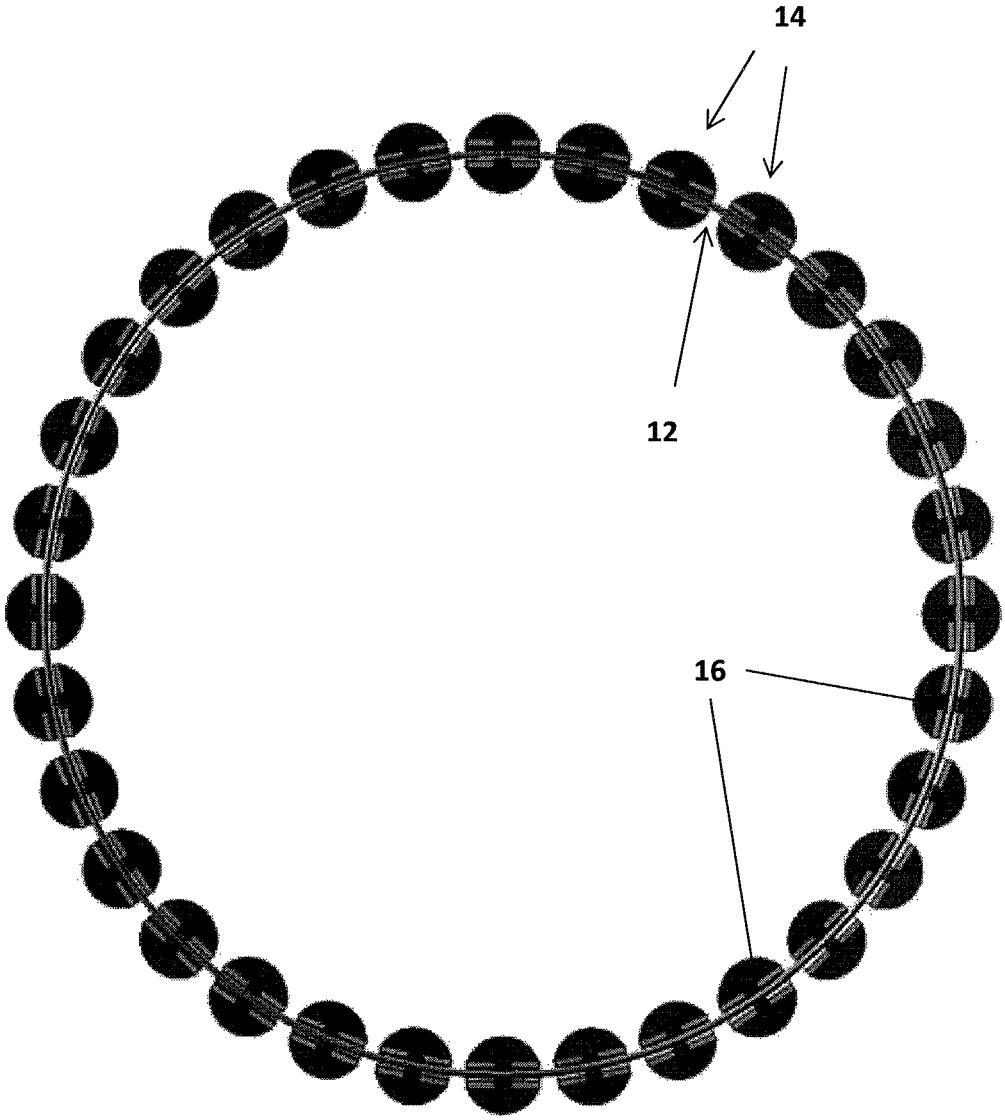
FIG. 5 depicts a cross section view of FIG. 1 depicting the pliable strand 12 extending through the magnetic insert 16.

Referring now to FIGS. 2 and 3, contact between objects 14 is avoided through the use of a magnetic insert 16 positioned within each object 14. The magnetic insert 16 is formed from two magnetic elements 18A, 18B separated from direct contact but joined by a magnetic stabilizer 20. In a preferred configuration the magnetic insert 16 extends the length or diameter of the object 14, such as by extending the length of a throughbore and thus extends between opposing surfaces of the object 14. In some configurations the object 14 is bored to form a throughbore, into which the magnetic insert 16 is fixedly positioned such as glued in place. Additional methods of positioning the magnetic insert 16 will become apparent in view of various embodiments set forth herein Turning to FIG. 4, the configuration of the magnetic insert 16 is such that the opposing ends of the magnetic insert 16 have the same polarity. That is, each magnetic insert 16 has opposing ends including either a north pole as depicted in FIG. 4 or a south pole. The poles are the same at each end. Use of the same polar orientation in each magnetic insert 16 causes each of the objects 14 to magnetically repel one another. Accordingly, this polar orientation of magnetic inserts 16 allows a pliable strand 12 to be used in lieu of a rigid rod. However, forming a magnetic insert 16 with opposing ends of the same polarity generates a technical challenge in forming the insert 16, itself. That is, poles of the same polarity must face each other within the magnetic insert 16 yet they will naturally repel one another. Gluing the poles directly was attempted; however, such an attempt proved too difficult as the strength of magnetic forces required to repel objects 14 was required. Thus the technical challenge needed to be overcome. The joining of magnetic ends that have the same polarity to form a magnetic insert 16 was eventually accomplished through the development of a magnetic stabilizer 20, preferably formed from a magnetizable metal or metal alloy, such as iron or steel. In preferred embodiments, the magnetic stabilizer 20 attracts both magnets 18A, 18B to magnetically form the magnetic insert 16. However, a technical challenged remained in the development of the magnetic stabilizer 20 to stabilize repulsive forces. Specifically while in early attempts the stabilizer 20 could attract one magnet 18A, repulsive forces from the second magnet 18B would overcome attraction by the magnetic stabilizer 20, which would thus force the first magnet 18A from contact with the stabilizer 20. Thus, it was eventually discovered that the thickness of the magnetic stabilizer 20 must be sufficiently thick that the forces of attraction between each of the two magnets 18A/18B and the stabilizer 20 is greater than the repulsive forces between the two magnets 18A/18B themselves. In consideration of both FIGS. 4 and 5, the magnetic insert 16 includes a throughbore 22 (also referred to as a magnetic throughbore 22) to permit threading of the pliable strand 12 through the object 14.

Figure 6:
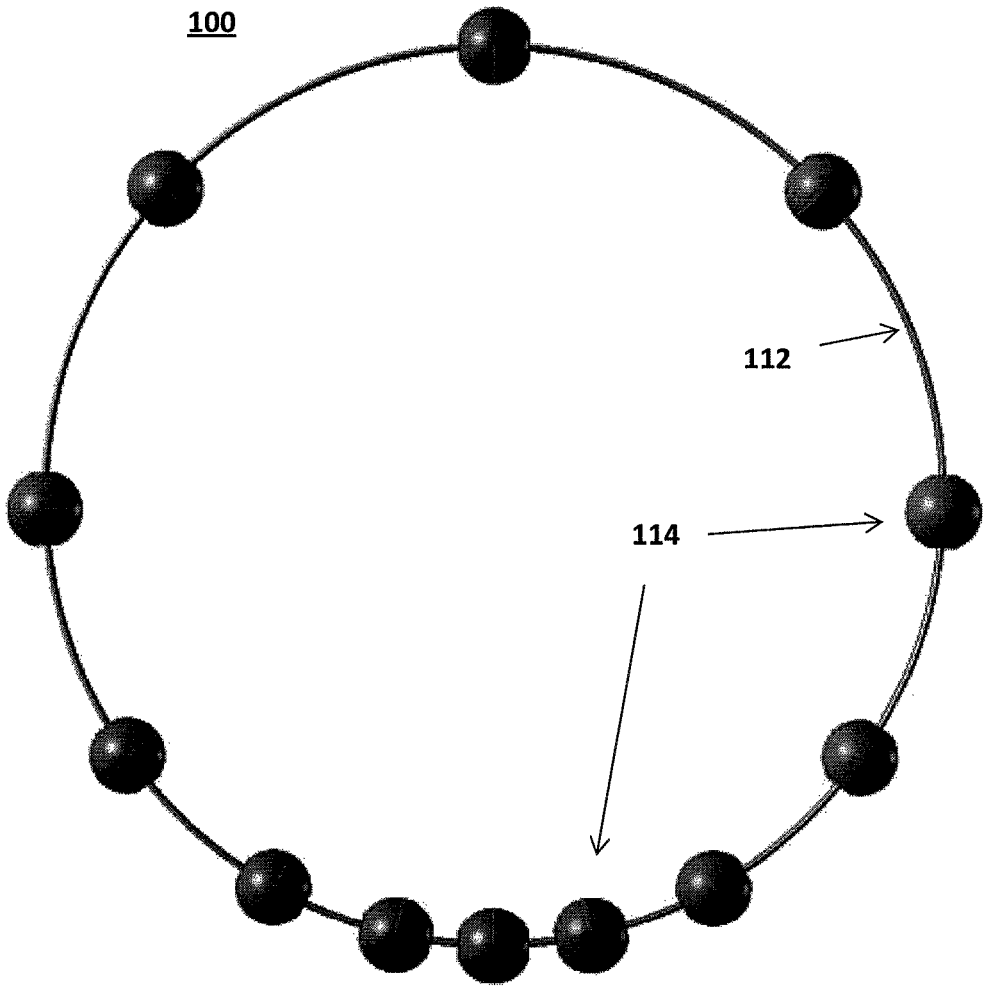
FIG. 6 depicts a necklace 100 with a pliable strand 112 with a plurality of objects 114 having variable spacing.
Figure 7:
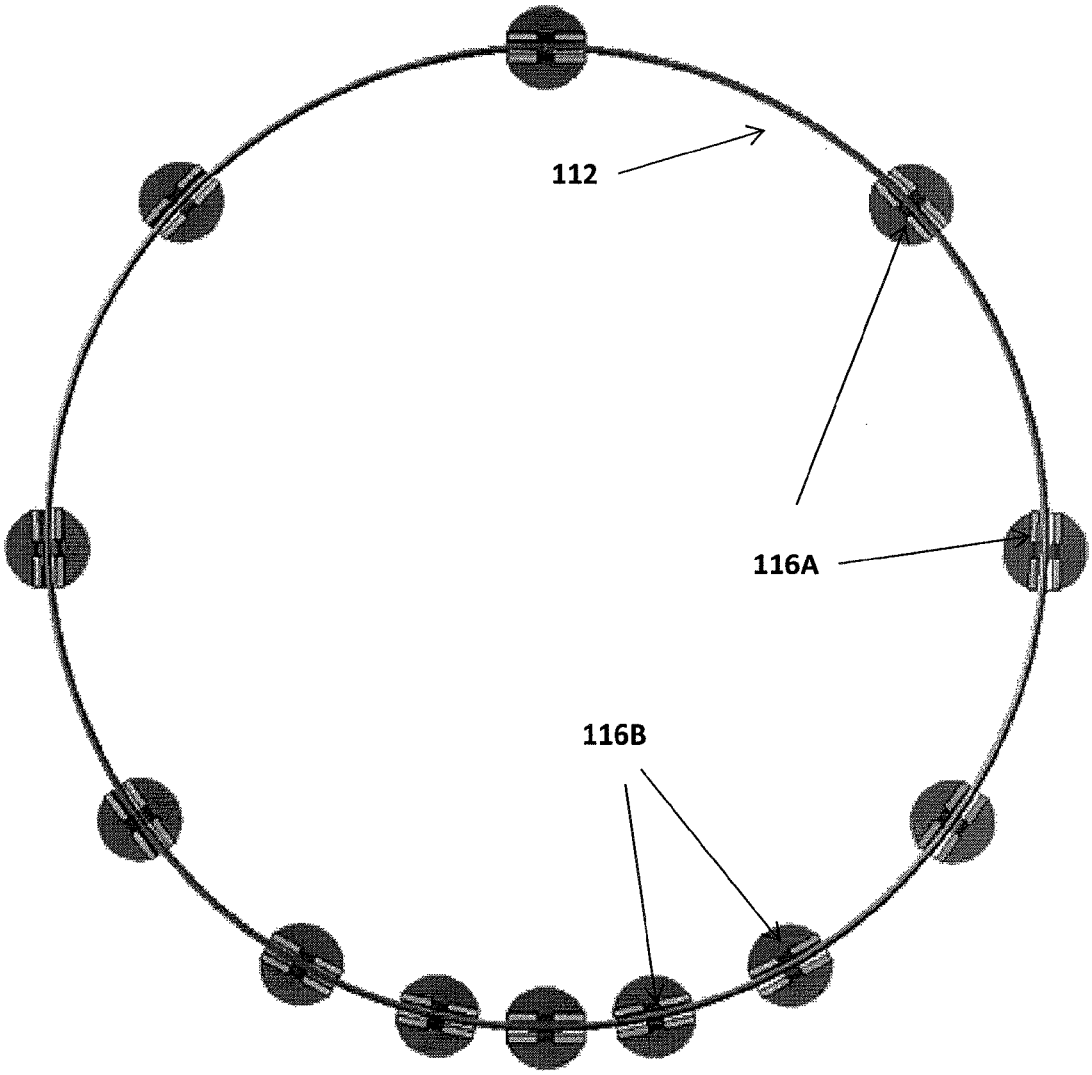
FIG. 7 is a cross section view of FIG. 6 depicting stronger magnetic inserts 116A and weaker magnetic inserts 116B.

The skilled artisan will appreciate jewelry articles can be adapted to have various configurations and thus additional nonlimiting embodiments are provided. For instance, turning to FIG. 6, a necklace 100 with pliable strand 112 can be constructed such that objects 114 have variable spacing. This can be accomplished by selectively changing magnetic strength throughout the objects 114. For instance referring to FIG. 7, a necklace 100 can include stronger magnetic inserts 116A in some areas of the necklace and weaker magnetic inserts 116B in others. Accordingly, the force of gravity will tend to counteract magnetic repulsion between weaker magnetic inserts 116B more than stronger magnetic inserts 116A. The skilled artisan will also now realize a similar effect can be accomplished by significantly varying the weight of objects 114; however, in most instances of jewelry construction using heavier weighted objects 114 would be less preferred.

In another approach objects 114 are uniformly positioned around a circular strand 112 by adding objects 114 until distances between neighboring objects 114 is desired. That is, additional objects 114 result in additional magnetic forces positioned within a defined distance along the strand 112.

Figure 8:
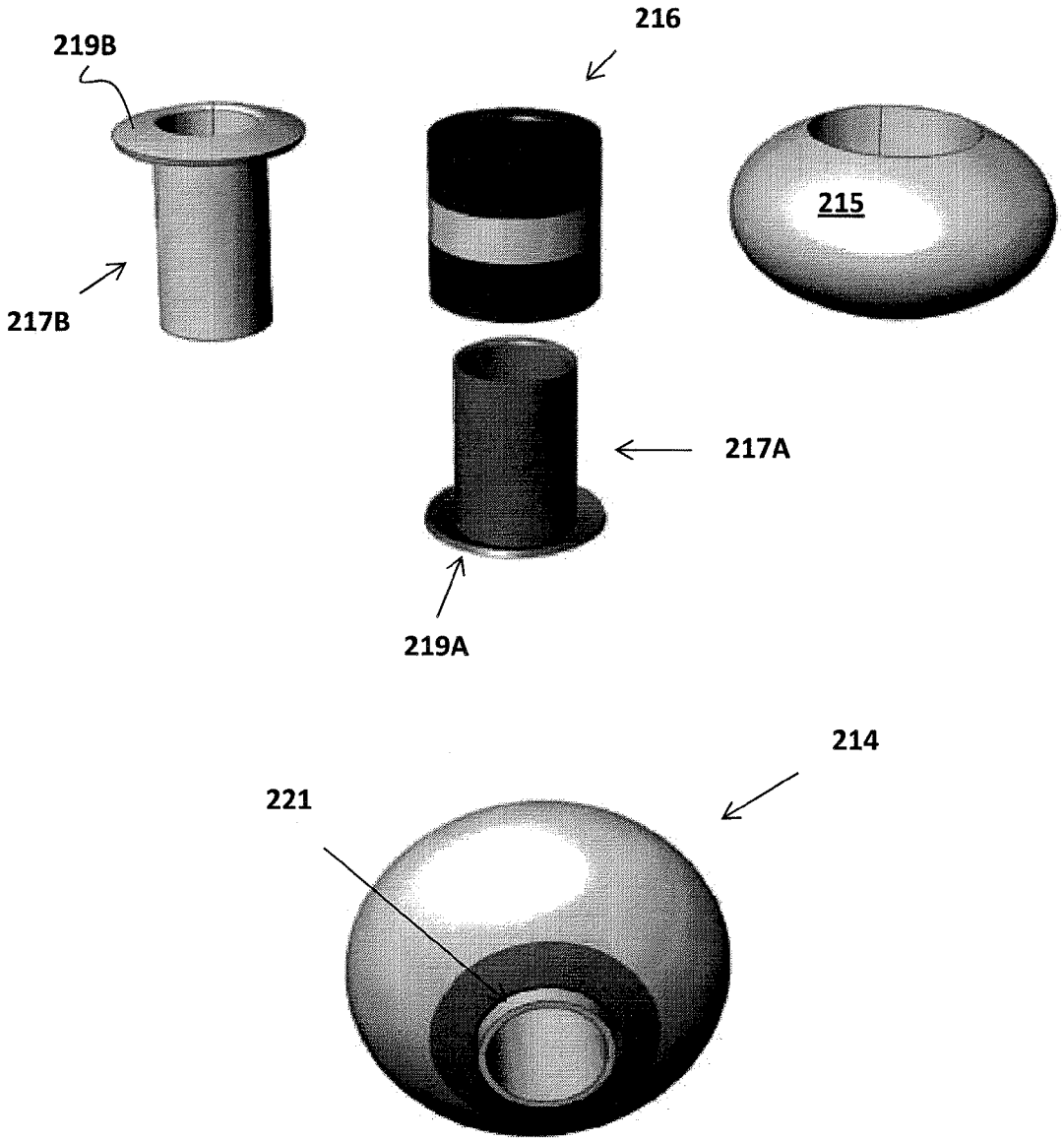
FIG. 8 depicts an exemplary object 214 formed from an outer gem 215 and a magnetic insert 216 that may be slidably provided over a pair of sleeves 217A, 217B.
Figure 9:
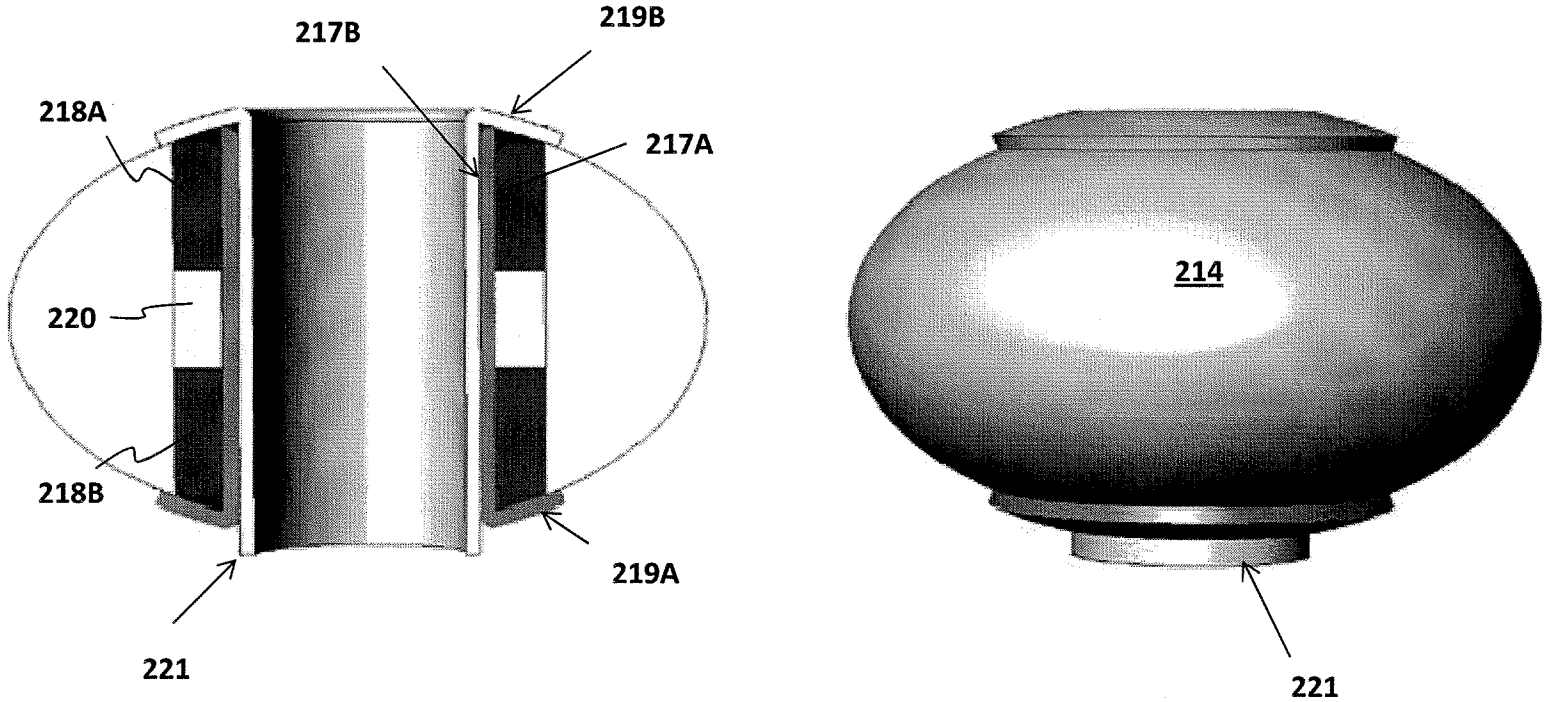
FIG. 9 depicts an exemplary object 214 and a cross section view to demonstrate positioning of two magnets 218A, 218B with magnetic stabilizer 220 surrounding outer sleeve 217A and inner sleeve 217B, each sleeve 217A, 217B is also shown with an indicia surface 219A, 219B, onto which indicia can be scribed, and an extension 221.

To assist the skilled artisan, additional embodiments are provided, which may have additional desired characteristics and thus may be favored by others. One such approach is depicted in FIGS. 8 and 9. Referring to FIG. 8, a suitable object 214 may be formed by drilling into a gem 215, slidably assembling a magnetic insert 216 around an outer sleeve 217A, followed by insertion into the gem 215. Next, an inner sleeve 217B is slidably inserted into the outer sleeve 217A. In a preferred method the inner sleeve 217B has an extension 221 that extends beyond the indicia surface 219A of the outer sleeve 217A. This permits the flaring outward of the extension 221 and fixedly joining the inner sleeve 217B to the outer sleeve 217A, which fixedly holds the sleeves 217A, 217B and magnetic insert 216 in place. The extension 221 can then be ground down or removed as known in the jewelry arts, As eluded to, the approach depicted in FIGS. 8 and 9 may be preferred when the user wishes to add additional indicia, such as brand information, gem grading, names, decorative features and the like to one or both opposing areas of the object 214. In this approach, each sleeve 217A, 217B can independently include an indicia surface 219A, 219B onto which indicia can be added.

A variety of methods of adding indicia are known in the jewelry arts, such as engraving and the like. Sleeves 217A, 217B can be constructed from metal, metal alloy and the like as known in the jewelry arts. Thus, in some embodiments magnets 218A, 218B may be spaced apart from one another, such as at each end of a sleeve 217A, 217B. Preferably an indicia surface 219A, 219B follows the contour of the gem 215.

Figure 10:
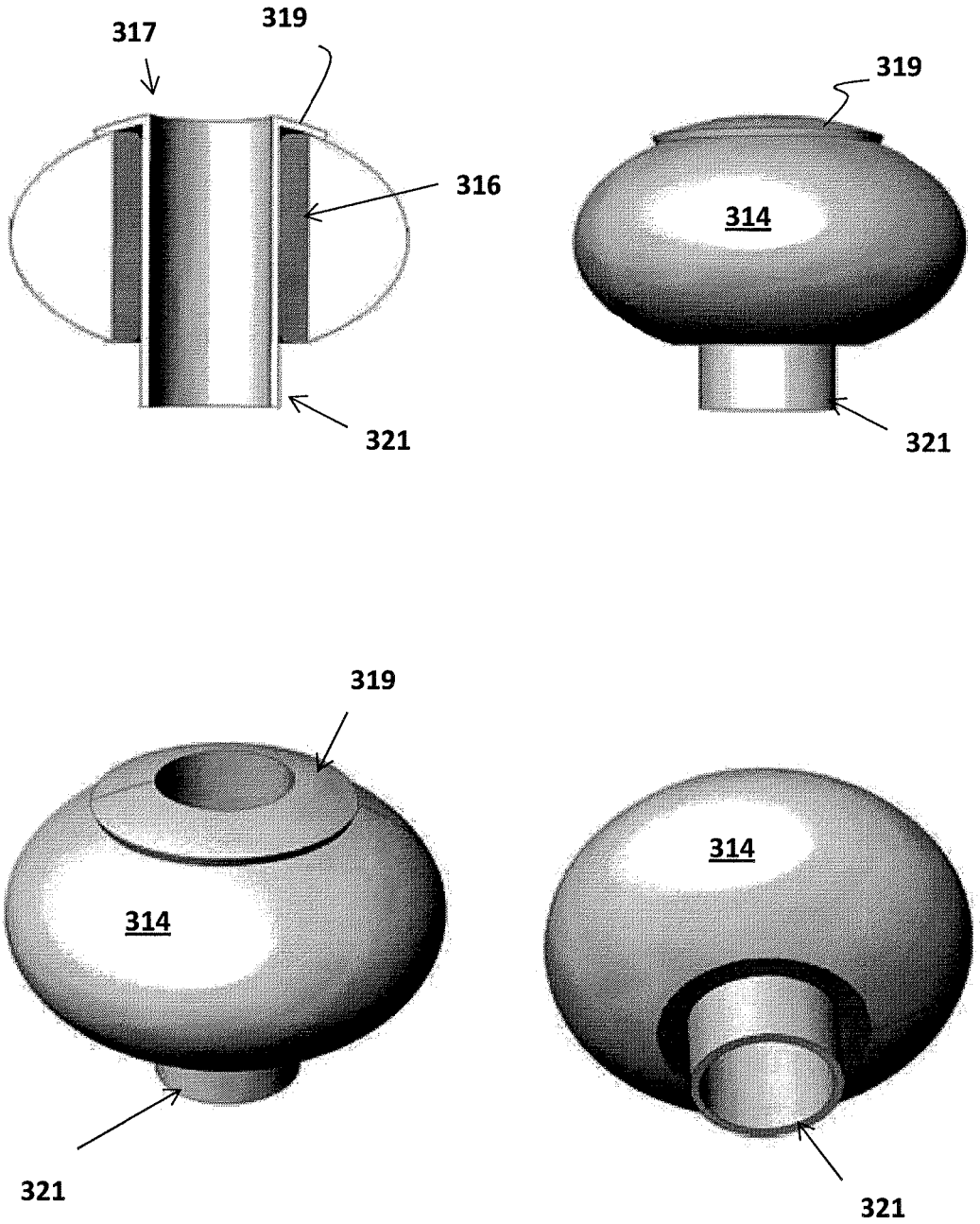
FIG. 10 depicts an exemplary object 314 shown in different views including a cross section to demonstrate the magnetic insert 316 around a sleeve 317 having an indicia surface 319 and a extension 321.

Turning now to FIG. 10, in another embodiment one or more objects 314 each include a magnetic insert 316 surrounding a single insertable sleeve 317. The sleeve 317 is shown having an indicia surface 319 onto which the user can add indicia. When using a single sleeve 317 additional care should be given if flaring an extension 321 outward. Too much force could cause the object 314 to crack. This is especially likely when flaring the extension to conform with an outer rounded contour of an object.

What is claimed is:

1. An article of jewelry comprising:

a) a pliable strand; and b) a plurality of precious or semiprecious objects movably positioned along the pliable strand, wherein each of the plurality of objects comprises a throughbore, through which extends:

i) a magnetic insert, which comprises two magnets separated by a magnetic stabilizer and aligned such that opposing ends of the magnetic insert comprise a same polarity, the magnetic insert comprising a throughbore, and ii) a sleeve extending through the throughbore of the magnetic insert and having an indicia surface that is outside of the throughbore of the magnetic insert; wherein opposing ends of each object has the same polarity thereby creating repulsive forces between neighboring objects to prevent contact.

2. The article of jewelry according to claim 1, wherein the magnetic stabilizer is a magnetizable metal or metal alloy.

3. The article of jewelry according to claim 2, wherein the magnetic stabilizer is provided at a width where the magnetic attraction between each magnet and the magnetic stabilizer is greater than repulsive forces between positioned magnets.

4. The article of jewelry according to claim 1, wherein the pliable strand is a necklace strand or a bracelet strand free from knots, wherein the plurality of objects remain free from contact with one another through the same polarity repulsive force.

5. The article of jewelry according to claim 1, wherein each opposing end of each object has a north pole polarity.

6. The article of jewelry according to claim 1, wherein each opposing end of each object has a south pole polarity.

7. The article of jewelry according to claim 1, wherein the objects are moveably positioned along the entirety of the strand and remain free from contact with one another.

8. The article according to claim 1, wherein the objects are independently selected from the group consisting of a pearl, a glass bead and a plastic bead.

9. The article of jewelry according to claim 1, wherein the pliable strand is positioned through the throughbore of each magnetic insert.

10. The article of jewelry according to claim 1, wherein at least two objects have magnetic inserts of different magnetic strengths.

11. The article of jewelry according to claim 1, wherein nearest neighboring objects are spaced equally from one another along the strand.

12. The article of jewelry according to claim 1, wherein nearest neighboring objects are spaced unequally from one another along the strand.

13. The article of jewelry according to claim 1, further comprising a second sleeve, wherein one of the sleeves is extended through the other sleeve and flared outward.

* * * * *